United States Patent [19]

Perez-Tubens et al.

[11] Patent Number: 4,542,838

[45] Date of Patent: Sep. 24, 1985

[54] GARMENT HANGER

[75] Inventors: Drucilla M. Perez-Tubens; Thomas R. Stewart, both of Fort Worth, Tex.

[73] Assignee: Frontier Antiques, Inc., Fort Worth, Tex.

[21] Appl. No.: 636,096

[22] Filed: Jul. 30, 1984

[51] Int. Cl.[4] ..... A47J 51/08

[52] U.S. Cl. ..... 223/87; 223/85

[58] Field of Search ..... 223/68, 87, 66, 71, 223/85, 92, 95; D6/315, 316, 317, 318, 319, 320, 321, 322, 323, 324, 325, 326, 327, 328, 329, 512, 513

[56] References Cited

U.S. PATENT DOCUMENTS

| | | | |
|---|---|---|---|
| 1,296,943 | 9/1916 | Gilkerson . | |
| 2,057,045 | 10/1936 | Moore | 223/87 |
| 2,141,540 | 12/1938 | Leash | 223/87 |
| 2,169,552 | 8/1936 | Bellin | 223/87 |
| 2,366,533 | 1/1945 | Kahn | 223/71 |
| 2,559,096 | 7/1951 | Tomarin | 223/87 |
| 2,609,977 | 9/1952 | Lausch | 223/92 |
| 3,065,946 | 11/1962 | Berkow | 223/87 X |
| 3,205,614 | 9/1965 | Brosk | 46/116 |

FOREIGN PATENT DOCUMENTS

| | | | |
|---|---|---|---|
| 2365990 | 4/1978 | France | 223/85 |
| 0660527 | 11/1951 | United Kingdom | 223/87 |
| 2126887 | 4/1984 | United Kingdom | 223/85 |

*Primary Examiner*—Louis K. Rimrodt
*Assistant Examiner*—Joseph S. Machuga
*Attorney, Agent, or Firm*—James E. Bradley

[57] ABSTRACT

A garment hanger displays upper and lower pieces of a woman's clothing in a proportional manner. The hanger has a sheet with a periphery formed in a silhouette of a woman's torso, with shoulder sections and hip sections. Slits are formed in the hip sections and the shoulder sections for receiving straps of the upper and lower garment pieces. A hook extends upwardly from the top of the sheet for hanging the sheet. Apertures are formed in the upper and lower portions of the sheet to allow plastic retainer lines to be inserted through the garment and sheet for retaining the garment to the sheet. The hook is detachable, having tabs that insert through slots in the sheet.

3 Claims, 5 Drawing Figures

GARMENT HANGER

BACKGROUND OF THE INVENTION

1. Field of the Invention

This invention relates in general to a hanger for hanging garments, and in particular to a corrugated paper hanger for displaying garments such as lingerie for sale in retail stores.

2. Description of the Prior Art

In retail stores, soft flexible garments, such as lingerie, are often displayed on shelves. Some stores may hang the garments on a conventional wire hanger or plastic hangers. In both cases, however, it is difficult for the purchaser to visualize how the garment will appear when worn.

Another problem with garments such as lingerie is theft. Lingerie is easily compressed and stuffed into a pocket or purse. While some stores have identification tags that will sound a warning if the garment is carried past sensors placed at the entrance to the store, many stores do not have this type of security. Also, there are disadvantages to this type of security in the case of lingerie.

SUMMARY OF THE INVENTION

In this invention, a garment hanger is provided that includes a stiff paper sheet. The sheet has a periphery formed in the silhouette of a woman's torso, with shoulder and hip sections. A pair of slits are located on each hip section for securing the straps or side portions of a lower garment piece, such as underpants. There are also a pair of slits on the shoulder sections. These slits serve to receive and retain a strap of the upper garment piece, such as the bra section. A hook extends upwardly from the top of the sheet for hanging the sheet on a rod.

The sheet also has one or more apertures located in the upper section for receiving plastic retainer lines. These lines are preferably price tag fasteners and extend through the sheet and garment. The fasteners have enlarged ends for retaining the garment to the sheet. There is also an aperture in the lower section for retaining the lower piece of the garment. The hook is preferably detachable and also formed of stiff paper.

DESCRIPTION OF THE PREFERRED EMBODIMENT

Figure 1:
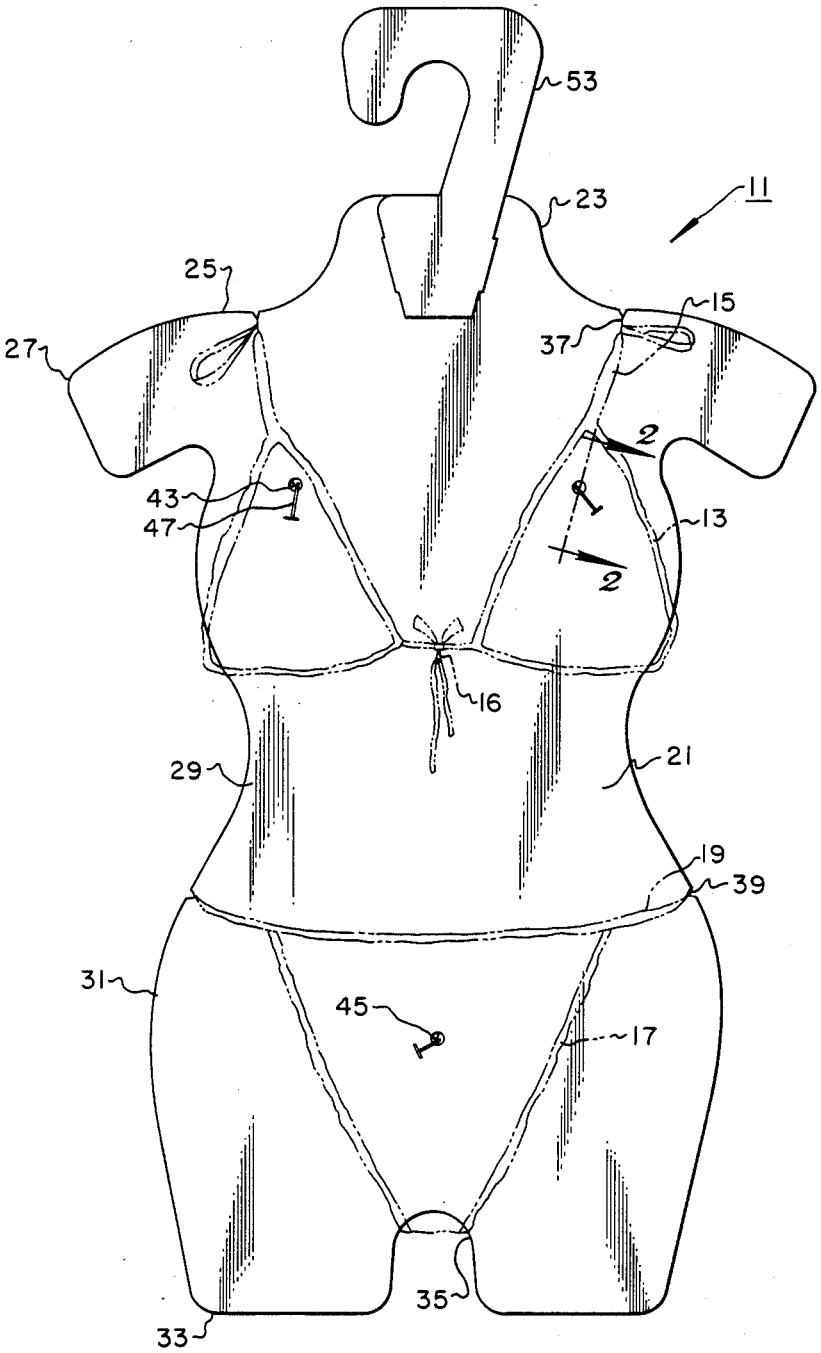
FIG. 1 is a front view of a garment hanger constructed in accordance with this invention.

Referring to FIG. 1, garment hanger 11 is particularly suited for supporting a garment that includes a separate upper piece 13. The upper piece 13 has straps 15 which extend over a woman's shoulders. The upper piece 13 shown in FIG. 1 is a bra section of a negligee, having two parts connected together by a tie-strap 16.

The garment particularly suited for garment hanger 11 also has a lower piece 17, which in the embodiment shown is panties for a negligee matching the bra upper piece 13. The lower piece 17 has straps or side portions 19 that extend around and hang on the hips of the user. The garment hanger 11 could also support swim suits, two-piece nightgowns and other garments.

Figure 2:
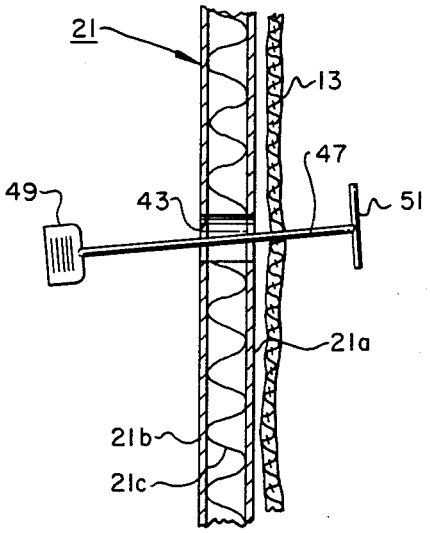
FIG. 2 is an enlarged sectional view of a portion of the hanger of FIG. 1, taken along the line 2—2 of FIG. 1.

Garment hanger 11 includes a flat sheet 21 of stiff paper located in a single plane. Sheet 21 is preferably formed of corrugated multiple ply paper, as shown in FIG. 2. This includes inner and outer plys **21*a* and 21*b* spaced-apart and interconnected with a corrugated ply 21*c***.

Referring again to FIG. 1, the sheet 21 has the periphery die cut in the shape of a silhouette of a woman's torso. The periphery will include a neck section 23 at the top, which separates two shoulder sections 25. The shoulder sections 25 lead into truncated arm sections 27. A waist section 29 extends inwardly in the central portion of sheet 21. Hip sections 31 extend outwardly and downwardly below the waist section 29. The hip sections 31 terminate in truncated leg sections 33. A crotch area 35 is located between the leg sections 33.

A shoulder fastening means retains the upper piece 13 of the garment and comprises a shoulder slit 37 cut into the upper side of each shoulder section 25. Each shoulder slit 37 is a small cut extending downwardly a short distance. The sides of the slit 37 are closely spaced together so as to allow the shoulder straps 15 to be brought through and doubled over to tightly hold the upper piece 13 in a position normal to the position worn by a woman.

Figure 4:
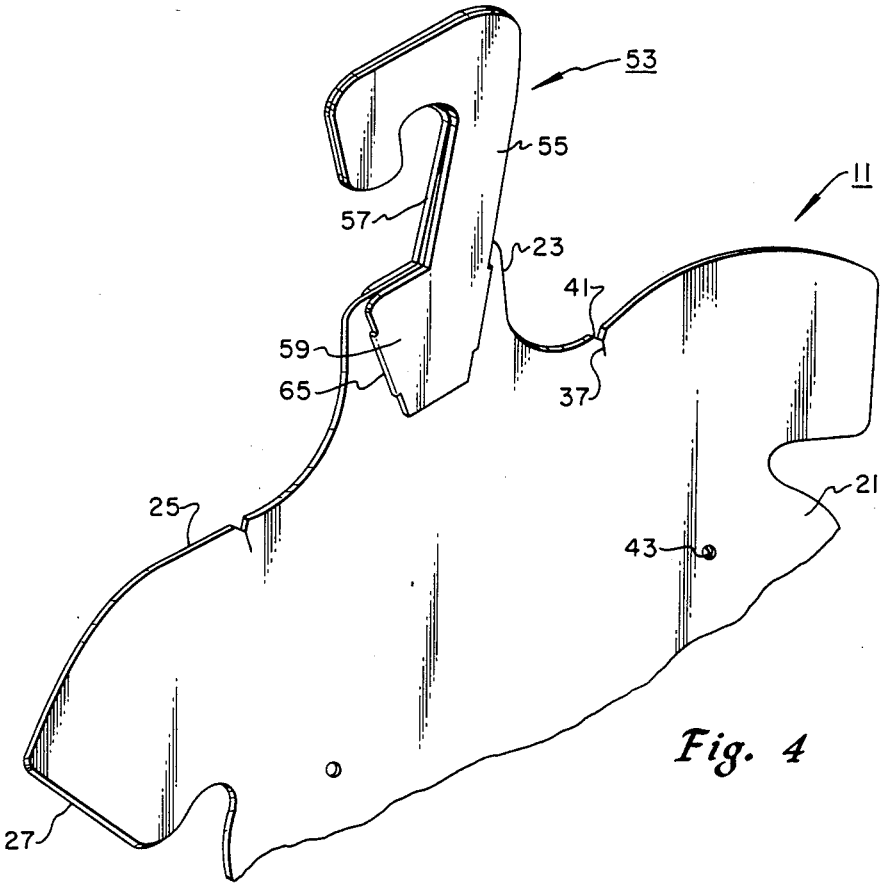
FIG. 4 is an enlarged partial view of the upper portion of the hanger of FIG. 1.

Similarly, there are two hip slits 39, each located on an upper portion of each hip section 31 that serve as hip fastening means to retain the lower piece 17. Each hip slit 39 is identical to the shoulder slit 37. Each hip slit 39 extends inwardly and slightly downwardly for receiving a strap 19 of the lower piece 17. Strap 19 can be doubled over and retained as shown. Each shoulder slit 37 and hip slit 39 has a beveled entrance section 41, as shown in FIG. 4. The beveled section 41 is the entrance to the slit and facilitates insertion of a portion of the garment.

Referring to FIG. 1, there are two apertures 43 spaced horizontally apart and located in an upper portion of sheet 21 below the arm sections 27. There is also an aperture 45 centrally located in a lower portion of sheet 21 below the hip slits 39. These apertures 43 and 45 serve to retain the garment with the hanger 11. Each aperture 43 and 45 is adapted to receive a retainer, preferably a conventional price tag fastener 47. As shown in FIG. 2, fastener 47 is a plastic filament or line, with enlarged ends 49 and 51 formed on each end. The line of the fastener 47 passes through the apertures 43 or 45 and also through the cloth of the garment, without damaging the garment. The enlarged ends 49 and 51 prevent removal of the garment from the sheet 21 unless one of the ends 49 and 51 is cut from the fastener 47.

Figure 3:
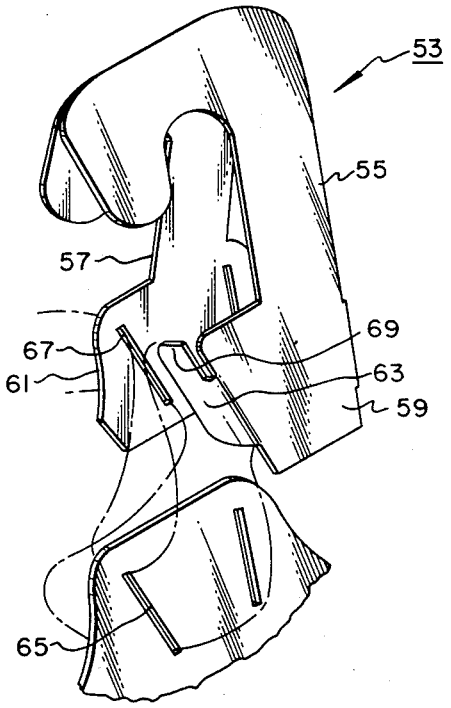
FIG. 3 is a partial perspective view of the hook portion of the hanger of FIG. 1.
Figure 5:
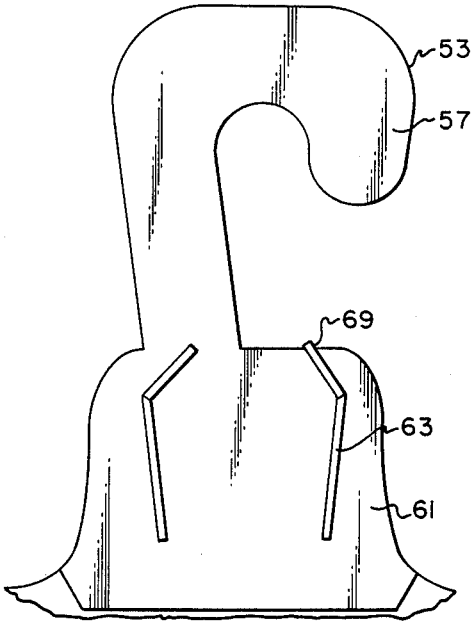
FIG. 5 is an enlarged view of the hook of the hanger of FIG. 1, shown from the opposite side shown in FIG. 1.

Referring to FIG. 1, a hook 53 extends upwardly from neck section 23 for hanging the garment hanger 11 on a rod (not shown). Hook 53 is preferably detachable so that it can be replaced with wear. The sheet 21 may undergo less wear and may be reused more often than hook 53 because sheet 21 will not be in contact with a supporting rod. The construction of hook 53 is shown in FIG'S. 3, 4 and 5. Hook 53 is preferably formed of front and back sections 55 and 57 which are formed together of the same corrugated sheet material as sheet 21. The sections 55 and 57 are connected together at the top and bent over at a fold line to define the shape of a hook, as shown in FIG. 3. Front section 55 has a lower portion 59, and back section 57 has a lower portion 61. A pair of tabs 63 are formed integrally with the lower portion 59. Tabs 63 are adapted to extend through a pair of slots 65 which are formed in the neck section 23. Slots 65 are formed at about a 15 degree angle with respect to a vertical line passing through the sheet 21. The tabs 63 also extend through slots 67 formed in the lower portion 61 of the back section 57. In this manner, the layers 55 and 57 sandwich the neck section 23. The tabs 63 have upper portions 69, as shown in FIG. 5, which can be bent over to prevent tabs 63 from becoming dislodged from the slots 65 and 67.

In operation, to place a garment on hanger 11, one places the upper piece 13 about the front and back of sheet 21. When the upper piece 13 is properly positioned, the straps 15 are brought upward and inserted and drawn down into each slit 37. Similarly, the lower piece 17 is placed about the lower portion of sheet 21, with the crotch area of the lower piece 17 located in the crotch area 35. Once properly positioned, the side straps 19 are drawn through the slits 39 to retain the proper positioning.

Then, a conventional device (not shown) for securing price tags to garments, is used to insert the fasteners 47 through the apertures 43 and 45 and the garment pieces 13 and 17. The device has a hollow needle that inserts through the holes 43 or 45 and through the garment. The fastener 47 is inserted through the hollow needle by the device in a well known manner. The fasteners 47 are preformed and loaded in multiples in the device. Once secured, the fastener 47 will retain the garment with the sheet 21.

The hook 53 is normally previously connected to the neck section 23 by folding the front and back sections 55 and 57 over, then inserting the tabs 63 through the slots 65 and 67. Once in place, the upper portions 69 of slot 65 are bent over to retain the hook 53 with the sheet 21. The hanger can then be placed on a rod for convenient viewing by customers.

When the customer selects a particular garment, he will bring the entire hanger 11 and garment to the clerk. The clerk wil cut the fasteners 47, allowing the garment pieces 13 and 17 to be removed from the sheet 21. The straps 15 are withdrawn from slits 37, and the straps 19 are withdrawn from slits 39. The garment is taken from sheet 21 and packaged for the customer. The garment hanger 11 can be reused with another garment.

The invention has significant advantages. The hanger, having a silhouette of a woman's torso, more attractively displays the goods. A customer can more easily visualize how the garment will appear when worn. The hanger allows the goods to be easily draped about the hanger in positions normal to that when worn. The apertures provide a measure of security by allowing conventional price tag fasteners to be inserted therethrough. The hanger can be reused many times, and additional hooks can be used with old hanger sheets to replace worn hooks.

While the invention has been shown in only one of its forms, it should be apparent to those skilled in the art that it is not so limited but is susceptible to various changes without departing from the scope of the invention.

We claim:

1. A garment hanger for displaying upper and lower pieces of women's clothing, comprising in combination:

a sheet having a periphery formed in a silhouette of a woman's torso with shoulder sections and hip sections;

a pair of hip slits, one on each hip section for securing to the sheet a side portion of a lower garment piece;

a pair of shoulder slits, one on each shoulder section, for securing to the sheet a strap of an upper garment piece;

hook means extending upwardly at the top of the sheet for hanging the sheet;

an upper aperture located in an upper portion of the sheet; and a lower aperture located in a lower portion of the sheet;

the upper and lower apertures positioned respectively for receiving plastic retainer lines for retaining the upper and lower pieces of the garment with the sheet;

the hook means comprising:

a flat hook-shaped member formed of paper and doubled over to provide separate back and front sections, the front section having a pair of flexible tabs adapted for insertion through a pair of slots in the neck section and a pair of slots in the back section, to secure the hook member to the neck section.

2. The hanger according to claim 1 wherein the sheet has a neck section between the shoulder sections from which the hook means extends.

3. The hanger according to claim 1 wherein the sheet has two truncated leg sections depending from the hip sections, defining a crotch area for receiving a crotch portion of the lower garment piece.

* * * * *